United States Patent [19]

Marino

[11] Patent Number: 4,874,258

[45] Date of Patent: Oct. 17, 1989

[54] BULK CARGO CONTAINER WITH INNER LINER

[75] Inventor: Frank J. Marino, Opa Locka, Fla.

[73] Assignee: Marino Technologies, Inc., Opa Locka, Fla.

[21] Appl. No.: 210,326

[22] Filed: Jun. 23, 1988

[51] Int. Cl.[4] ..... B65D 30/08

[52] U.S. Cl. ..... 383/111; 383/41; 383/904

[58] Field of Search ..... 383/11, 41, 111, 904

[56] References Cited

U.S. PATENT DOCUMENTS

| | | | |
|---|---|---|---|
| 3,422,867 | 1/1969 | Wu | 383/111 |
| 3,955,728 | 5/1976 | Jackson et al. | 383/111 |
| 4,211,266 | 7/1980 | Massey | 383/904 |
| 4,222,422 | 9/1980 | Lofberg | 383/111 |
| 4,300,608 | 11/1981 | Cuthbertson | 383/904 |
| 4,356,853 | 11/1982 | Sekiguchi | 383/904 |
| 4,390,051 | 6/1983 | Cuthbertson | 383/111 |
| 4,637,063 | 1/1987 | Sullivan et al. | 383/111 |
| 4,646,357 | 2/1987 | Nattrass | 383/104 |

*Primary Examiner*—Stephen P. Garbe

*Attorney, Agent, or Firm*—Bell, Seltzer, Park & Gibson

[57] ABSTRACT

Releasable fastening devices are provided in spaced-apart locations on the inner surface of the outer bag and in adjacent locations on the outer surface of the inner liner. The adjacent fastening devices are easily connectable together to maintain the liner in conforming condition relative to the outer bag member during both loading of material into the cargo container and unloading of material from the cargo container. The releasable fastening devices are also easily separable to premit removal of the liner from the outer bag member.

4 Claims, 2 Drawing Sheets

BULK CARGO CONTAINER WITH INNER LINER

FIELD OF THE INVENTION

This invention relates generally to a cargo bag with a removable impervious liner, and more particularly to such a cargo bag in which releasable mechanical fastening devices are fixed in spaced-apart locations on the inner portion of the cargo bag and to the outer portion of the liner so that the liner is maintained in conforming condition inside of the cargo bag, and so that the liner can be easily removed therefrom.

BACKGROUND OF THE INVENTION

It is generally known to provide an impervious inner liner inside of a woven fabric cargo bag in order to protect the contents from invasion by water and the like. For example, U.S. Pat. No. 4,596,040 discloses an inner impervious plastic liner positioned within and generally conforming to an outer cargo bag formed of woven flexible material. However, this patent provides no means for attaching the liner to the cargo bag so that it is difficult to insure that the liner will conform to the configuration of the cargo bag when being filled with granular material or the like.

U.S. Pat. No. 3,961,655 also discloses a plastic liner positioned inside of a cargo bag of woven flexible material and being attachable to the upper filling skirt of the cargo bag, without attachment of the sides of the liner to the inside surface of the cargo bag. The liner of this patent is also difficult to maintain in conforming condition with the outer bag while being filled with granular material.

In an attempt to overcome the deficiencies of the inner liners in the cargo bags disclosed in these two prior patents, U.S. Pat. No. 4,597,102 discloses an inner liner for a cargo bag in which each of the four corners of the inner liner are provided with outwardly extending tabs. These tabs are sewn into seams formed along each corner of the outer cargo bag. While the inner liner of this patent is maintained in conforming condition to the outer bag during filling with granular material, the inner liner of this patent cannot be easily removed therefrom so that the cargo bag can be used without the inner liner in position.

U.S. Pat. No. 4,658,989 discloses an impervious inner liner which is provided with spaced-apart pressure-sensitive adhesive spots for adhering the outer surface of the inner liner to the inner surface of the cargo bag when the liner is inflated. Strings or lines are attached to the spots of the pressure-sensitive adhesive and extend outwardly through the open top of the bag so that the flexible inner liner can be removed from the cargo bag after the granular material has been discharged from the bag. However, the pressure-sensitive spots on the outer surface of the liner make it difficult to insert the inner liner into the cargo bag. Also, the mechanism required to inflate the inner liner to cause the pressure-sensitive adhesive spots to stick to the inner walls of the bag is not always readily available and further complicates the process of inserting the inner liner into the bag.

SUMMARY OF THE INVENTION

With the foregoing in mind, it is an object of the present invention to provide a cargo bag with a removable inner impervious liner in which releasable mechanical fastening devices are provided in spaced-apart locations adjacent the upper and lower ends of the side walls of the cargo bag and are fixed thereto as well as to the adjacent portions of the outer surface of the liner. The mechanical fastening devices may be connected together to maintain the liner in conforming condition relative to the outer bag during both loading of material into the cargo bag and unloading of material from the cargo bag, and the fastening devices may be separated to permit removal of the liner from the outer cargo bag.

In accordance with the present invention, the releasable fastening devices preferably include tie strings having one end fixed in each corner of the cargo bag and adjacent both the upper and lower junctures of the side walls with the top and bottom walls. The ends of the tie strings are preferably attached to the outer bag by being incorporated in the seams connecting the top and bottom walls to the side walls. The releasable fastening devices also include loops secured to and extending outwardly from spaced-apart locations on the inner liner and extending outwardly therefrom. The loops are positioned to be substantially aligned with the tie strings attached at one end to the cargo bag so that the ties can be connected together through the loops to maintain the liner in conforming condition relative to the outer cargo bag during both loading of material into the cargo container and unloading of material from the cargo container. The ties can be easily untied and disconnected from the loops to permit removal of the liner from the outer bag member.

In another disclosed embodiment, the releasable mechanical fastening devices are disclosed in the form of strap members with snap fasteners provided in their free end portions. In a further disclosed embodiment, the releasable fastening devices are disclosed in the form of strap members having the male and female portions of a Velcro fastener provided thereon. One of these strap members is adapted to extend through a loop member and is releasably connected to the other strap member.

BRIEF DESCRIPTION OF THE DRAWINGS

Other objects and advantages will appear as the description proceeds when taken in connection with the accompanying drawings, in which.

DESCRIPTION OF THE PREFERRED EMBODIMENTS

Figure 1:
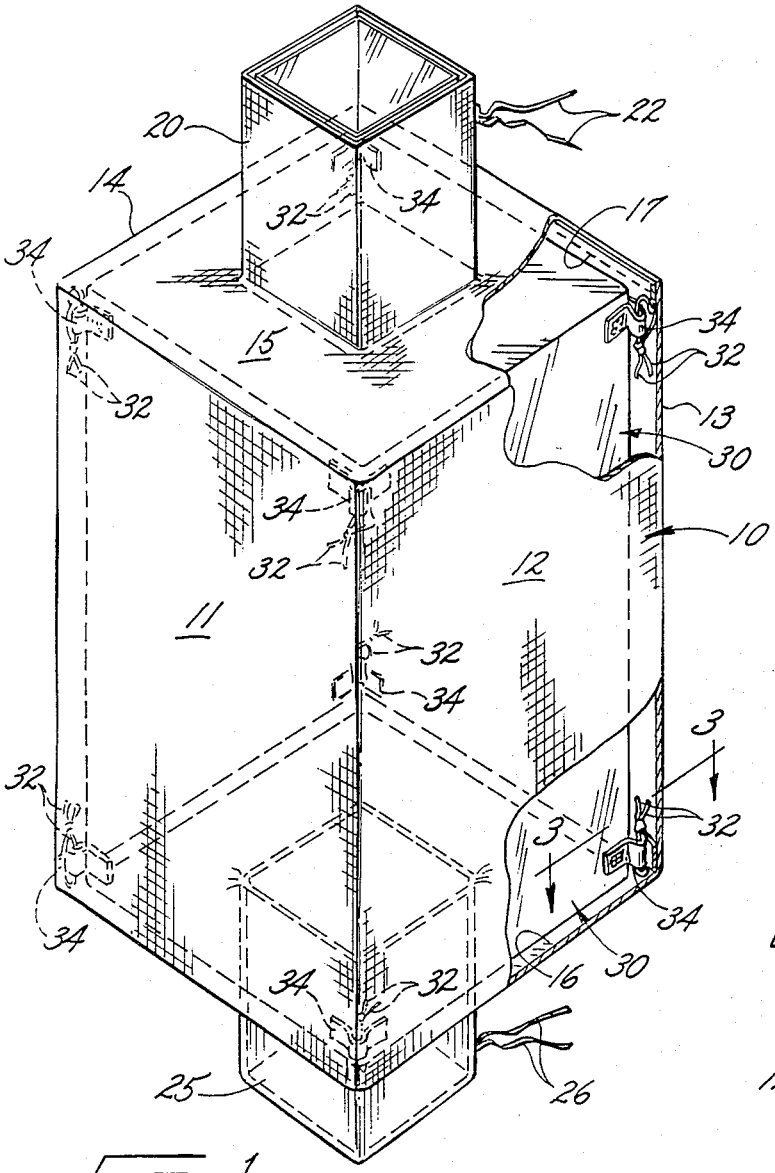
FIG. 1 is a perspective view of a bulk cargo container in accordance with the present invention and with portions broken away to illustrate the attachment of the impervious liner therein.

As illustrated in the drawings, the bulk cargo container of the present invention includes an outer bag member, broadly indicated at 10, formed of flexible material and including upstanding and interconnected side walls 11–14. The flexible material of the outer bag member 10 is usually formed of woven polyethylene yarns and the side walls 11–14 may be formed of tubular woven fabric, or they may be formed of flat woven material which is seamed together along one of the corners. The outer bag member 10 also includes respective top and bottom walls 15, 16 which are joined around their peripheral edges to the respective upper and lower ends of the side walls 11–14 by a seam, indicated in FIG. 2 as a line of stitching 17.

The top wall 15 is provided with an upstanding central filling tube 20 having its lower end stitched to the top wall 15. The filling tube 20 is provided with a closure, illustrated in the form of tie strings 22 (FIG. 1), attached at one end to the filling tube 20. A discharge tube 25 is stitched at its upper end to the center of the bottom wall 16 and extends downwardly therefrom. Suitable closure tie strings 26 are connected at one end to the discharge tube 25. The outer bag 10 may be provided with any suitable type of lifting loops or straps, not shown.

An impervious inner liner, broadly indicated at 30, of flexible plastic material is positioned within the outer bag 10. The liner 30 includes an outer surface generally conforming to the inner surface of the outer bag 10, including upstanding and interconnected side walls, top and bottom walls, an upper filling tube, and a lower discharge tube. The distance between the outer surface of the inner liner 30 and the inner surface of the outer bag 10 has been exaggerated in the drawings to more clearly illustrate the mechanical means for releasably fastening the inner liner 30 in the outer bag 10.

The mechanical means for releasably fastening the inner liner 30 inside of the outer bag 10 illustrated in FIGS. 1–5 includes first fastening means, in the form of ties 32, having adjacent ends fixed to the outer bag member 10 by being penetrated by the line of stitching 17 (FIG. 2) joining the top wall 15 to the side walls 11–14. As illustrated in FIG. 1, the tie strings 32 are fixed in spaced-apart locations adjacent the upper and lower ends of the side walls 11–14 and adjacent each corner of the outer bag 10. However, it is to be understood that the tie strings 32 could be fixed to the outer bag 10 in other spaced-apart locations adjacent the upper and lower ends of the side walls 11–14.

Figure 2:
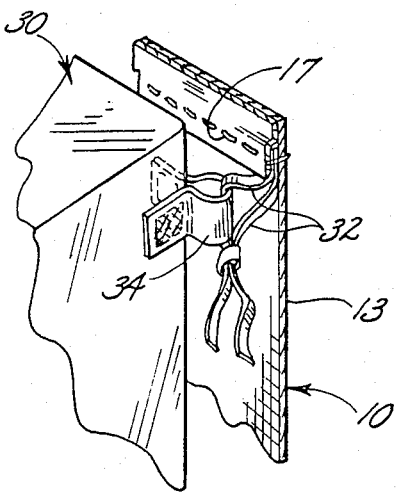
FIG. 2 is an enlarged fragmentary view of the upper right-hand portion of FIG. 1 and illustrating the manner in which the ties are connected to the loop element of the fastening device.
Figure 3:
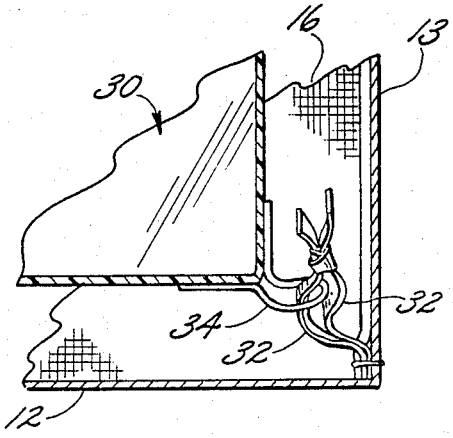
FIG. 3 is an enlarged fragmentary horizontal sectional view taken substantially along the line 3—3 in FIG. 1.
Figure 4:
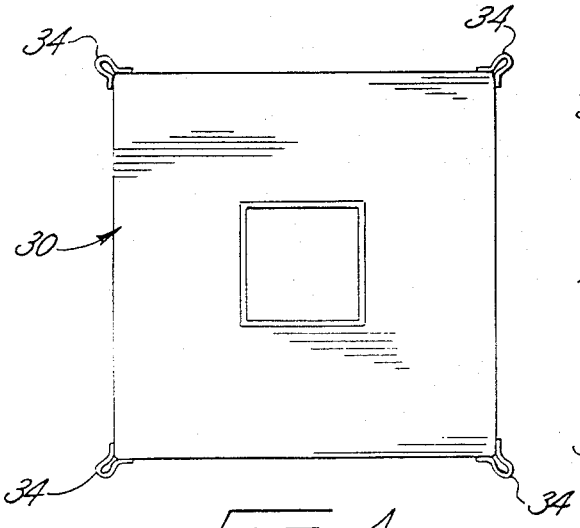
FIG. 4 is a plan view of the impervious inner liner, removed from the outer cargo bag.
Figure 5:
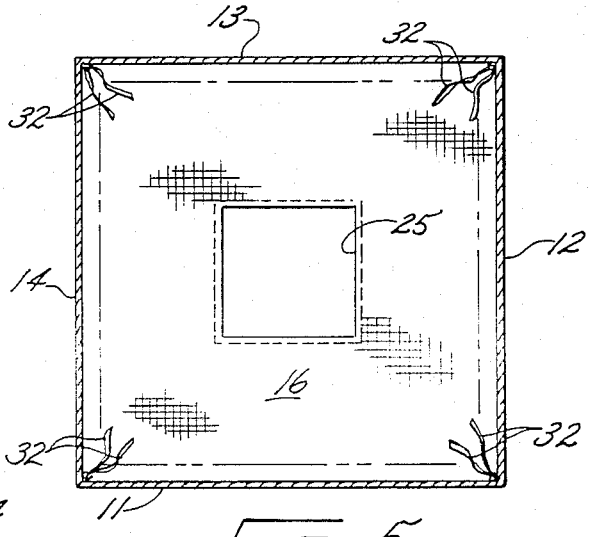
FIG. 5 is a horizontal sectional view through the bulk cargo container of FIG. 1, with the inner liner removed therefrom.

Second fastening means, illustrated in FIGS. 1–4 as loops 34, are fixed to the liner 30 and in positions closely adjacent the tie strings 32. The loops 34 are formed of plastic strap material and have opposite ends attached to adjacent side walls of the inner liner 30 and adjacent the upper and lower portions thereof. Opposite ends of the loops 34 are attached to the inner liner 30 by any suitable means, such as by double-sided pressure sensitive tape, heat sealing, or the like. After the inner liner 30 is positioned in the outer bag 10, the tie strings 32 can be releasably connected to the loops 34 by passing one of the tie strings through the loop and tying the two tie strings 32 together, as illustrated in FIGS. 1–3. Thus, the inner liner 30 is maintained in conforming condition relative to the outer bag 10 during both loading of granular material into the cargo container and unloading of the granular material from the cargo container. If it is subsequently desired to use the outer cargo bag 10 without the inner liner 30, the tie strings 32 are merely untied to permit the liner 30 to be removed through either end of the cargo bag 10. While the tie strings 32 are described as being fixed in the seams of the outer bag 10 and the loops 34 are described as being attached to the inner liner 30, it is to be understood that these parts could be reversed, if desired.

Figure 6:
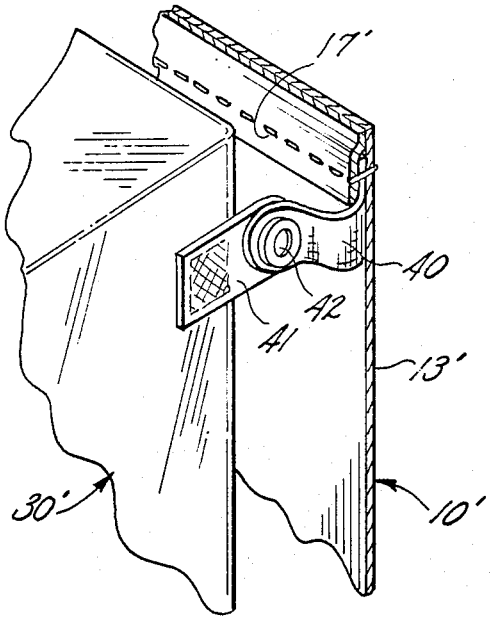
FIG. 6 is a view similar to FIG. 2 but illustrating an alternate embodiment of the fastening device.

Also, other suitable types of mechanical releasable fastening means can be utilized in place of the tie strings 32 and the loops 34. As illustrated in FIG. 6, one end of a first strap member 40 is attached by the line of stitching 17' along the juncture of the side wall 13' of the outer cargo bag 10. One end of a second strap member 41 is attached to the adjacent side wall of the inner bag 30 and the free ends of the strap members 40, 41 are provided with suitable snap fasteners 42 which may be easily connected together to maintain the liner 30 in conforming condition relative to the outer bag 10'. The snap fasteners 42 may also be easily separated to permit removal of the liner 30' from the outer bag 10'.

Figure 7:
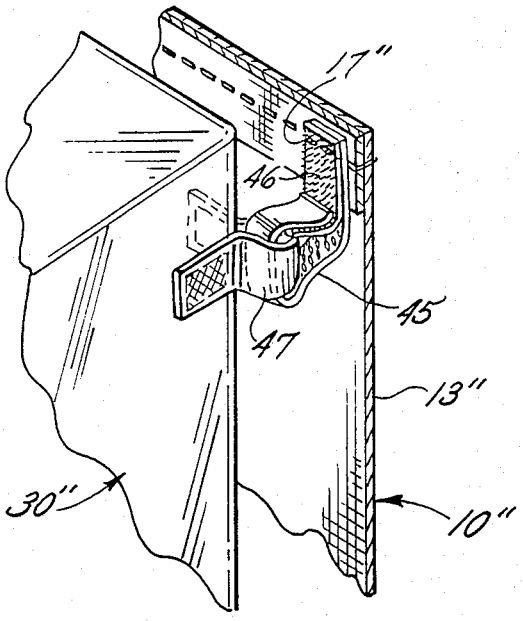
FIG. 7 is a view similar to FIG. 6 but showing another embodiment of the fastening device.
Figure 8:
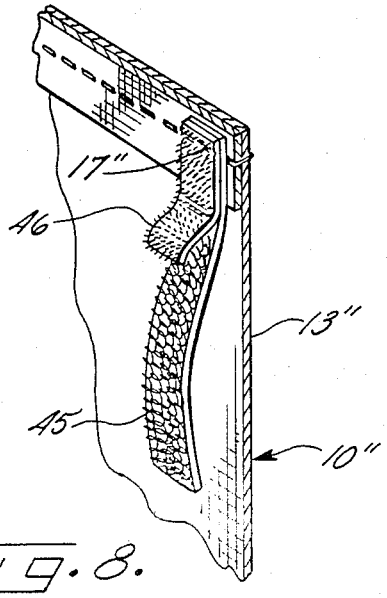
FIG. 8 is a fragmentary view of the right-hand portion of FIG. 7 showing the fastener straps removed from the loop member.

In the embodiment shown in FIGS. 7 and 8, the mechanical releasable fastening means includes a strap member 45 having the female elements of a Velcro fastener provided thereon, and a strap member 46 having the male elements of a Velcro fastener provided thereon. The end portions of the strap members 45, 46 are fixed at one end in the line of stitching 17'' and at the upper edge of the side wall 13'' of the outer bag 10''. The strap member 45 having the female elements of the Velcro fastener provided thereon is passed through a loop member 47 suitably secured to the adjacent side walls of the inner liner 30''. The free ends of the strap members 45, 46 may then be easily connected together to maintain the liner 30'' in conforming condition relative to the outer bag member 10'' during both loading of material into the cargo container and unloading of material from the cargo container. Also, the free end portion of the strap member 45 may be easily separated from the strap member 46 and removed from the loop 47 to permit easy removal of the liner 30'' from the outer bag member 10''.

Thus, the mechanical releasable fastening means of the present invention includes first fastening means fixed to one of the outer bag member and the liner and in spaced-apart locations adjacent the upper and lower ends of the side walls thereof. Second fastening means is fixed to the other of the outer bag member and the liner and is positioned adjacent the first fastening means. The first and second fastening means are connectable together to maintain the liner in conforming condition relative to the outer bag member during both loading of material into the cargo container and unloading of material from the cargo container. The first and second fastening means is also easily separable to permit removal of the liner from the outer bag member when it is desired to utilize the outer bag without an inner liner, or when it is desired to exchange one inner liner for another.

In the drawings and specification there have been set forth the best modes presently contemplated for the practice of the present invention, and although specific terms are employed, they are used in a generic and descriptive sense only and not for purposes of limitation, the scope of the invention being defined in the claims.

That which is claimed is:

1. In a bulk cargo container comprising an outer bag member formed of flexible material and including upstanding and interconnected side walls, top and bottom wall means associated with the respective upper and lower ends of said side walls, and seam means extending around at least portions of the upper and lower ends of said side walls and serving to join said top and bottom wall means thereto, and an impervious inner liner of flexible material positioned within said outer bag member and including an outer surface generally conforming to the inner surface of said outer bag member, the combination therewith of means for releasably fastening said liner in said outer bag member, and wherein said releasable fastening means includes first mechanical fastening means fixed to the inner surface of said outer bag member and in spaced-apart locations adjacent the upper and lower ends of the side walls thereof, and second mechanical fastening means fixed to the outer surface of said liner and positioned adjacent said first fastening means, said first and second fastening means being contained entirely within the area between the inner surface of said outer bag member and the outer surface of said liner and being connectable together to maintain said liner in conforming condition relative to said outer bag member during both loading of material into said cargo container and unloading of material from said cargo container, and said first and second fastening means being separable to permit removal of said liner from said outer bag member.

2. In a bulk cargo container according to claim 1 wherein said first fastening means comprises tie string means, and wherein said second fastening means comprises loop means through which said tie string means is attachable.

3. In a bulk cargo container according to claim 1 wherein said releasable fastening means comprises snap fasteners.

4. In a bulk cargo container according to claim 1 wherein said releasable fastening means comprises Velcro fasteners.

* * * * *